US005820041A

United States Patent [19]

Moessmer et al.

[11] Patent Number: 5,820,041

[45] Date of Patent: Oct. 13, 1998

[54] FOOD CUTTING APPARATUS

[75] Inventors: Michael Moessmer, Betzweilerwaelde; Eberhard Haack, Halle, both of Germany

[73] Assignee: Maschinenfabrik Dornhan GmbH, Dornhan, Germany

[21] Appl. No.: 880,013

[22] Filed: Jun. 20, 1997

[30] Foreign Application Priority Data

Jun. 20, 1996 [DE] Germany ..... 196 24 573.7

[51] Int. Cl.[6] ..... B02C 18/30

[52] U.S. Cl. ..... 241/82.5; 241/247; 241/236

[58] Field of Search ..... 241/82.1–82.7, 241/260.1, 246, 247, 165.5, 152.2, 236

[56] References Cited

U.S. PATENT DOCUMENTS

| | | | |
|---|---|---|---|
| 2,247,012 | 6/1941 | Burk | 241/82.5 |
| 4,512,523 | 4/1985 | Higashimoto | 241/82.5 |

FOREIGN PATENT DOCUMENTS

| | | | |
|---|---|---|---|
| 2595266 | 9/1987 | France | 241/82.5 |
| 325371 | 9/1920 | Germany | 241/82.5 |
| 1074595 | 2/1984 | U.S.S.R. | 241/82.5 |
| 1727901 | 4/1992 | U.S.S.R. | 241/82.5 |

*Primary Examiner*—Mark Rosenbaum
*Attorney, Agent, or Firm*—Karl Hormann

[57] ABSTRACT

A suspension arrangement for rotatable feed worms of food cutting apparatus and knives mounted thereon for rotation thereby. The feed worms are provided with coaxially extending bearing pins which are mounted for resiliently biased movement in a coaxial recess of the worms and which are journaled in bearings provided in a cutting disk. Releasable means are provided for moving the cutting disk relative to the bearing pin and knife mounted thereon.

14 Claims, 11 Drawing Sheets

FOOD CUTTING APPARATUS

BACKGROUND OF THE INVENTION

1. Field of the Invention

The invention, in general, relates to novel food cutting apparatus and, more particularly, to a novel cutter and suspension of feed worms in rotary food grinders provided with feed and working worms positioned in succession and along a plurality of axes, the feed worms being preferably arranged in parallel and rotating in opposite directions.

In known meat grinder of this kind, feed and working worms are suspended in several planes, and it is known at the junction of feed worm and working worm to structure the bodies of the worms in a special manner for the purpose of obtaining flawless feeding or conveying of the raw material from the feed worm to the working worm.

Thus, German patent DD 289,220 A5 discloses a feed worm in meat grinders which is provided with a feed enhancing member in the section where the material to be ground is received. The feed enhancing member is a flute of the worm extending over about one quarter to one half of a convolution. It is structured as a single or a multiple member, and its pitch differs by up to 20% from the ordinary pitch of the worm flute.

Such meat grinders suffer from the disadvantage that in the change-over area from the feed worm to the working worm, where the material to be ground passes from the large feed worm to the smaller working worm, that is to say, from the slowly rotating feed worm to the rapidly rotating working worms, it is not possible to establish a defined pressure build-up in the material to be processed. This has an adverse effect on the quality of the ground material and on the energy consumed by the grinding process.

In accordance with German patent specification DE 4,431,959 C1 this disadvantage is overcome by a variable removable and adjustable pressure chamber directly in the change-over area from the feed worm to the working worm. The pressure chamber may be adjusted in its design, structure and lay-out to accommodate specific operating conditions.

This is accomplished by a pressure chamber formed by placing inserts into the feed hopper, over the feed worms.

Such a construction does ensure the build-up, in the immediate change-over area between feed worm and working worm, of the pressure necessary to affect the immediate change-over operation in a positive way.

It is, however, disadvantageous that the pieces of raw material transferred to the working worm are large. These large pieces are received by the worm which then shreds them at the entrance into the pressure tube. That is to say, in the change-over chamber the passing of raw material leads to accumulations of material which are larger than the volume of the flute. This again leads reduced quality outputs.

Design and operation of the cutting machines described above are determined by the basic premise that a working worm is associated with a feed worm, and that a cutter assembly is arranged at the output end of the working worm. While such an arrangement ensures a pressure build-up in the immediate change-over area from feed worm and working worm, the build-up has no effect whatever on the ensuing diminution process.

It is a further disadvantage of meat grinders of the general kind that the journals of the feed worms required to ensure proper functioning of the meat grinders are complex in terms of their structure and manufacture. Even cantilevered mountings of shafts or of feed worms do not alleviate the complexity of their manufacture, nor do they lead to reduced disassembly and assembly times. A large distance relative to the wall of the hopper or in the change-over area reduces the effect by 30 to 50%.

OBJECTS OF THE INVENTION

It is thus a general object of the invention to provide cutter and suspension systems for food cutting machinery which ensure a pressure build-up in the change-over of material to be cut from a feed worm to a succeeding working worm.

It is a more specific object of the invention to provide such cutting and suspension systems in food cutting machines functioning in the manner of meat grinders.

Another object is to provide such cutting and suspension systems in meat grinders having a plurality of worm systems.

It is also an object of the invention to provide a cutting and suspension system of the kind referred to which reduces the wear and tear on components of such machines, thus resulting in an increased useful life and reduced energy consumption.

Another object is to provide a novel suspension for resiliently mounting a feed worm and rotary cutting knives associated therewith.

Yet another object is to provide a compression mount for a feed screw and cutter assembly.

Finally, it is an object of the invention to provide a cutting and suspension system providing for a flawless change-over of raw material at the junction of feed and working worms.

BRIEF SUMMARY OF THE INVENTION

In the accomplishment of these and other objects, the invention, in a preferred embodiment thereof, provides for a cutting and suspension system of the kind referred to with a change-over area between coplanarly disposed feed worms and a working worm and a cutting system positioned in the change-over area, the cutting system comprising a double precutter with associated knives and perforated disks and compression mounted by a filling and closure member extending at least partially around the operating worm, the filling and closure member having a quick release closure associated therewith.

The double cutter disposed between the feed worms and the working worms precuts the raw material advanced by the parallel feed worms and transferred in diminuted form to the working worm, prevents return flow of the raw material and terminates the diminution and feed process.

The resilient compression mounting of the double cutter is ensured by resilient means cooperating with external tension applied by a securely arrested clamping block.

The double cutting system is made up of a pair of precutters arranged in side by side relationship and each having a knife positioned against it. The precutters are formed as a single element, herein sometimes referred to as a dual precutter, which is positioned at the output end of the feed worms. Each of the knives is positioned at a predetermined angle with respect to the final flute convolution of its feed worm and to the other knife.

The precutter is provided with center bores in which bearing bushes seated for receiving bearing pins, and with web members in which the feed openings for the raw material are positioned and which are dimensioned to correspond to the opening widths of the flute convolutions of the feed worm and, in the change-over area, of the working worm.

The arrangement of the double precutter is such that it may be placed onto the bearing pins of the feed worms, circumferentially arrested by the pressure housing and compression mounted by a filling and closure member.

In accordance with the invention the dual cutter may be enhanced by cutting means in addition to rotary knives and perforated cutting disk. Thus, additional knives and perforated disks may be coaxially mounted to provide for a plurality of successive cutting or chopping actions.

Preferably, the rotary knives are driven by bearing pins of the worms to which they may be keyed to prevent rotation relative to the pins.

The suspension of the feed worm relative to the working worm is such that their axes are disposed in a common plane, and the dual cutter is suspended by a filling and closure member extending over the working worm into biased engagement with an abutment which directly presses against the dual cutter.

The biasing of the filling and closure member is accomplished by an arcuate member provided with a quick-release fixture and which ensure a predetermined positioning of the working worm relative to the feed worm and the dual cutter arrangement.

The rotary knives positioned in front of a cutting disk of the dual cutter are angularly displaced relative to each other such that their blades do not interfere with each other during rotation. Preferably, the angle of displacement is between 30° and 50°.

The knives are driven by keyed engagement with a bearing pin of the feed worms in front of the final convolution of the flute thereof.

Excessive wear and tear of the knives and of the cutting disk engaged by them is prevented by polymeric bolts protruding from the axial surfaces of the knives.

Cooperation between the feed worms and the working worm as well as the knives of the system is ensured by their structural lay-out.

The knives are mounted for axial resilient movement on bearing pins which are mounted for resilient movement in an coaxial recess in the shaft of the feed worms and which are compressed by a releasable filling and closure member.

The bearing pins are concentrically journaled in the respective knife arrangement, and an abutment on the pins is provided resiliently to bias the knives against the cutting plate of the dual precutter at a predetermined shear force.

In an advantageous embodiment the knives are bias against the cutting plate of the dual cutter by a filling and closure member pressing the cutting plate against the axially resiliently supported knives.

Rotation of the knives by the feed worms is ensured by a keying arrangement between the knives and the final flute of the feed worm.

Preferably, a pressure chamber is provides at the output end of the feed worm and adjacent the working worm which is configured to enhance the feeding of material to be cut into the dual cutter and which provides lateral support to the material.

Uniform distribution over the working worm of the material to be cut is provided by the coplanar mounting of the feed worms and the working worm. The uniform distribution of the precut material provides for the uniform feeding thereof by the working worm under the required pressure to a final cutting arrangement.

The dual cutter between feed worms and working worm prevents any back flow of raw material from the working worm.

BRIEF DESCRIPTION OF THE SEVERAL DRAWINGS

The novel features which are considered to be characteristic of the invention are set forth with particularity in the appended claims. The invention itself, however, in respect of its structure, construction and lay-out, as well as manufacturing techniques, together with other objects and advantages thereof, will be best understood from the following description of preferred embodiment when read together with the appended drawings, in which:

Figure 1:
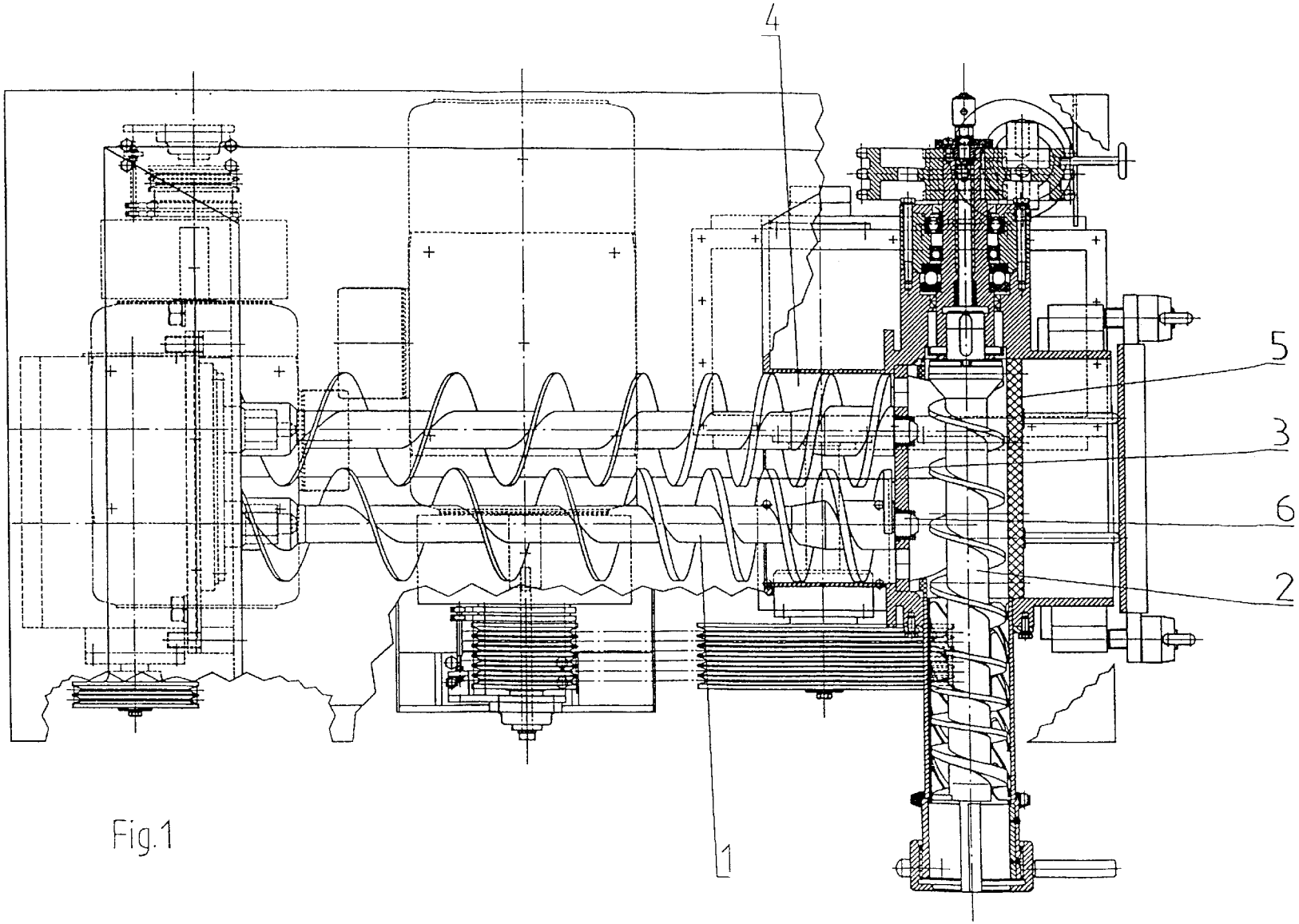
FIG. 1 is an overall view, in schematic presentation, of the arrangement of feed worms with respect to the working worm.
Figure 6:
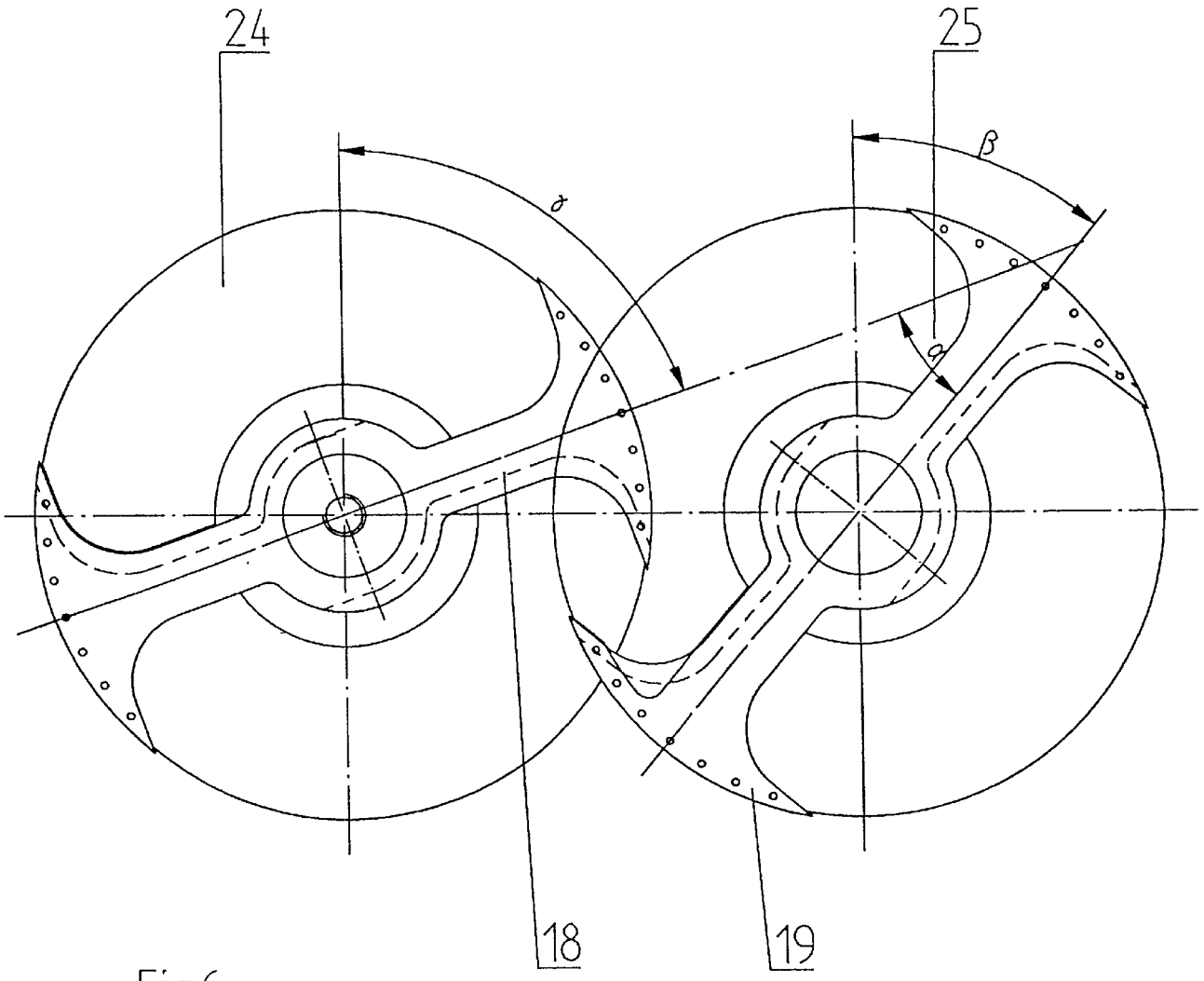
Figure 7:
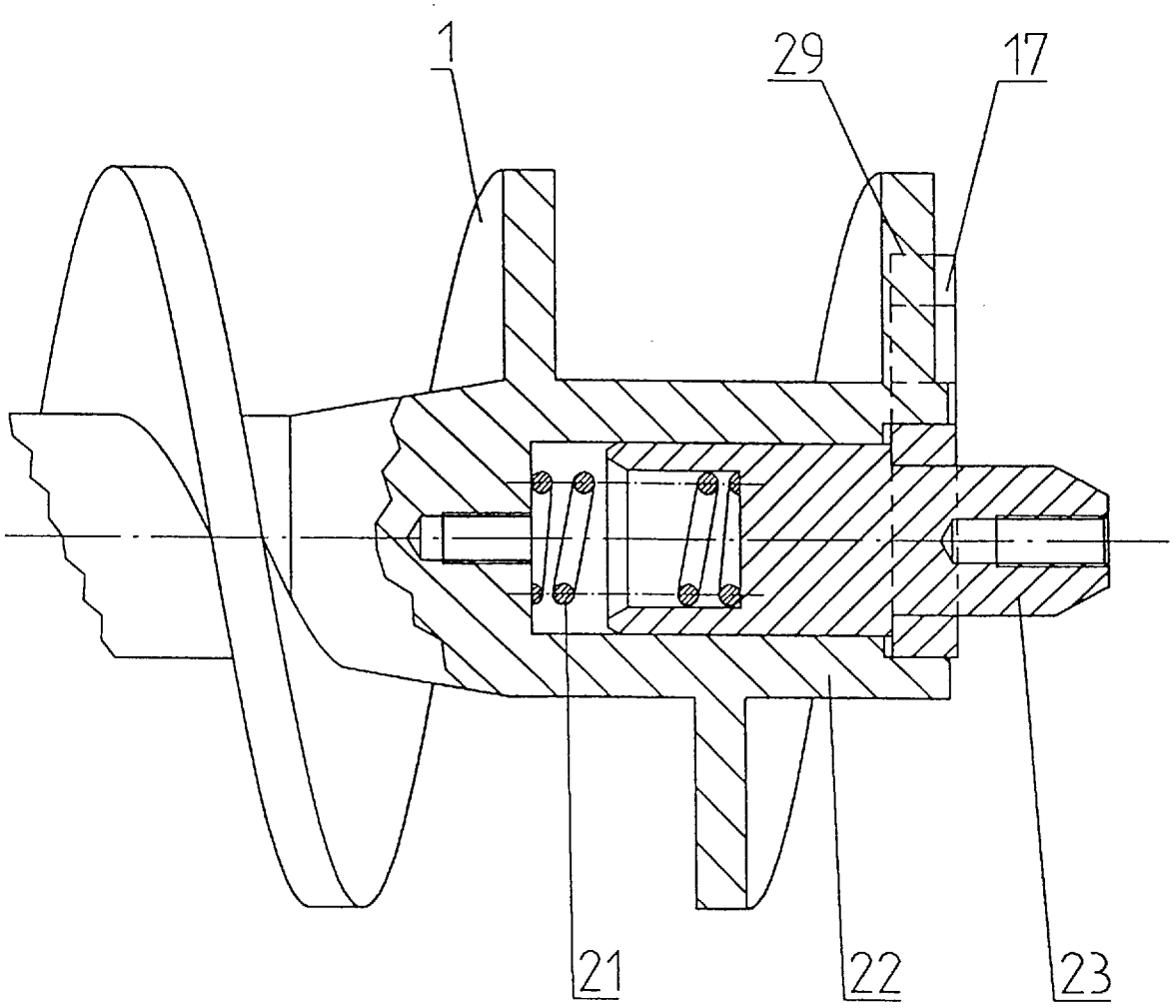
Figure 8:
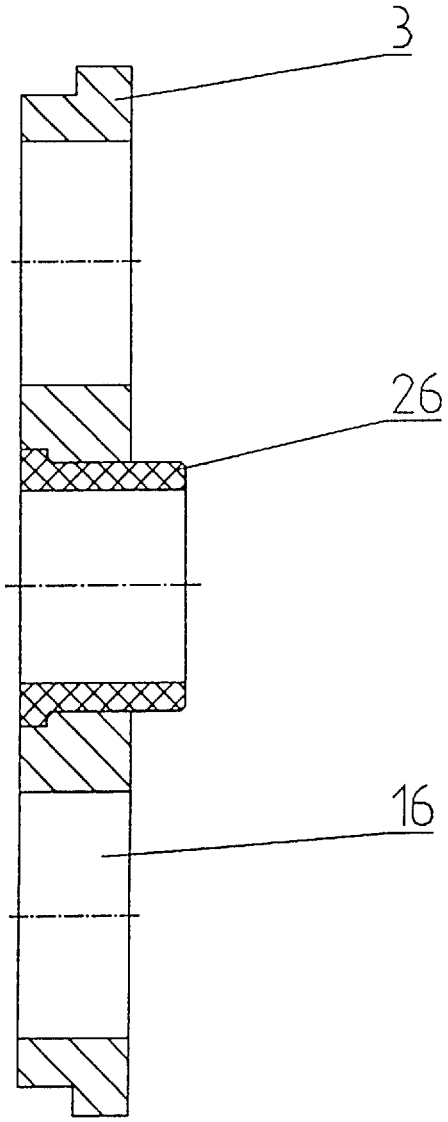
Figure 9:
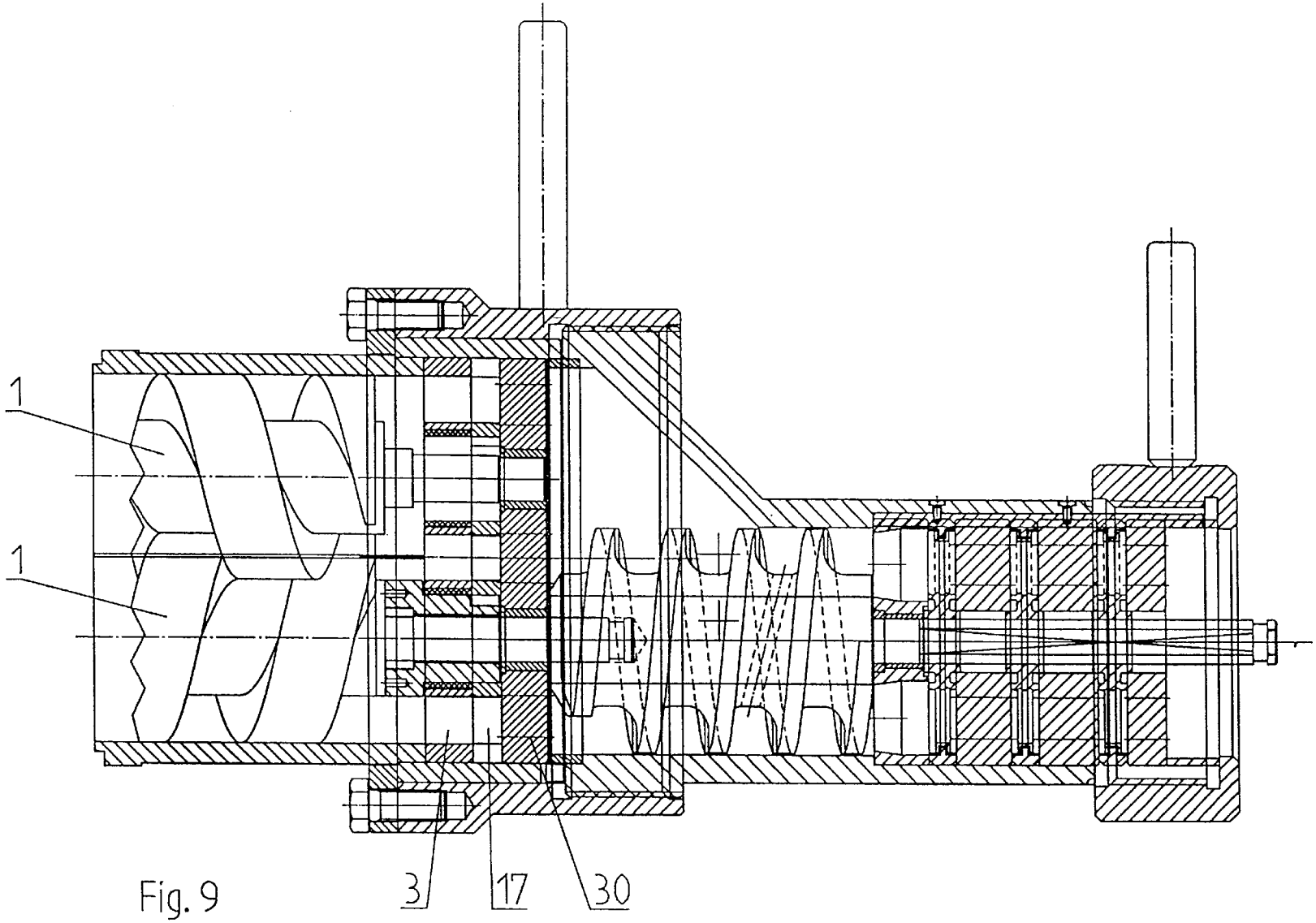
Figure 10:
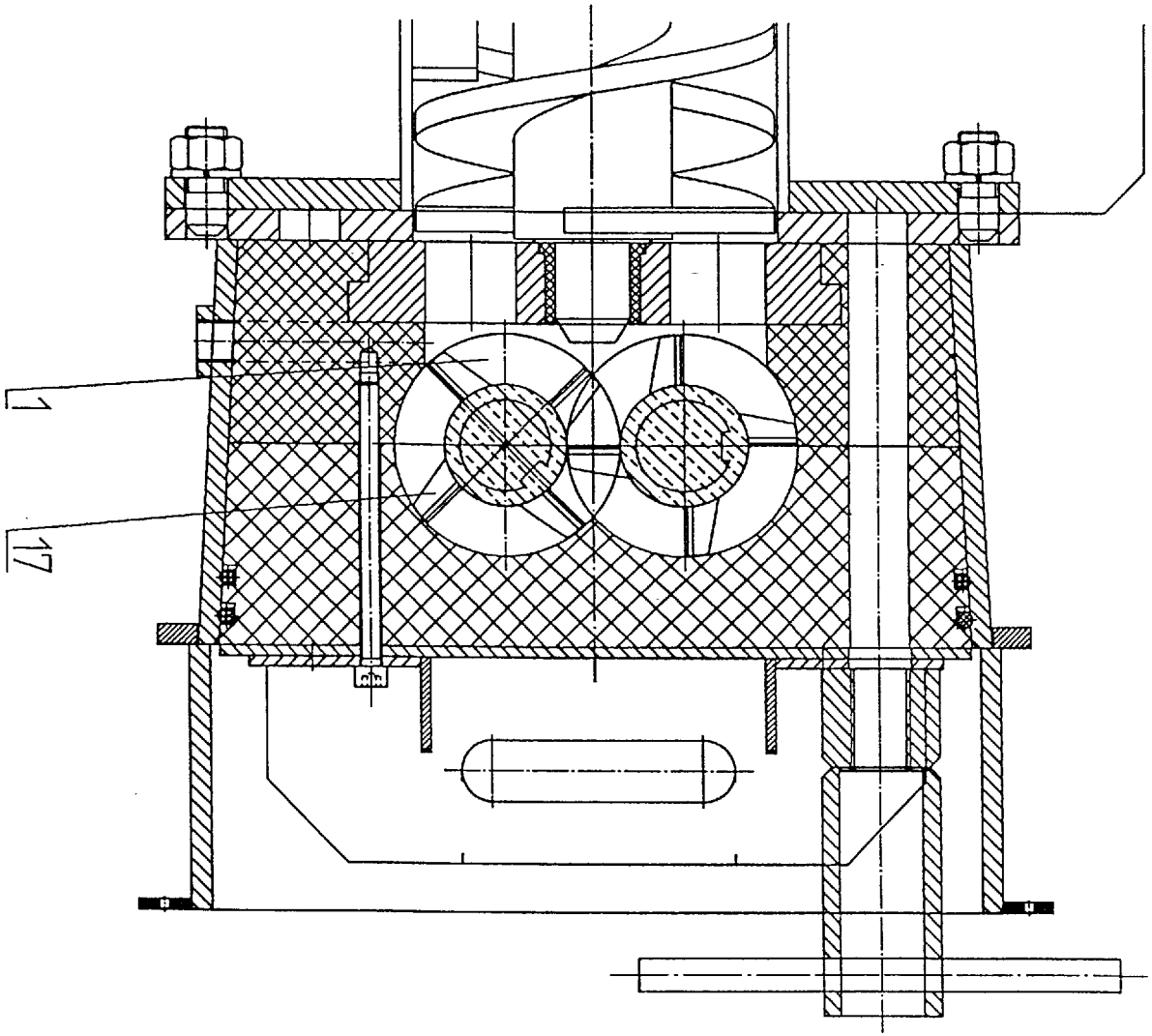
Figure 11:
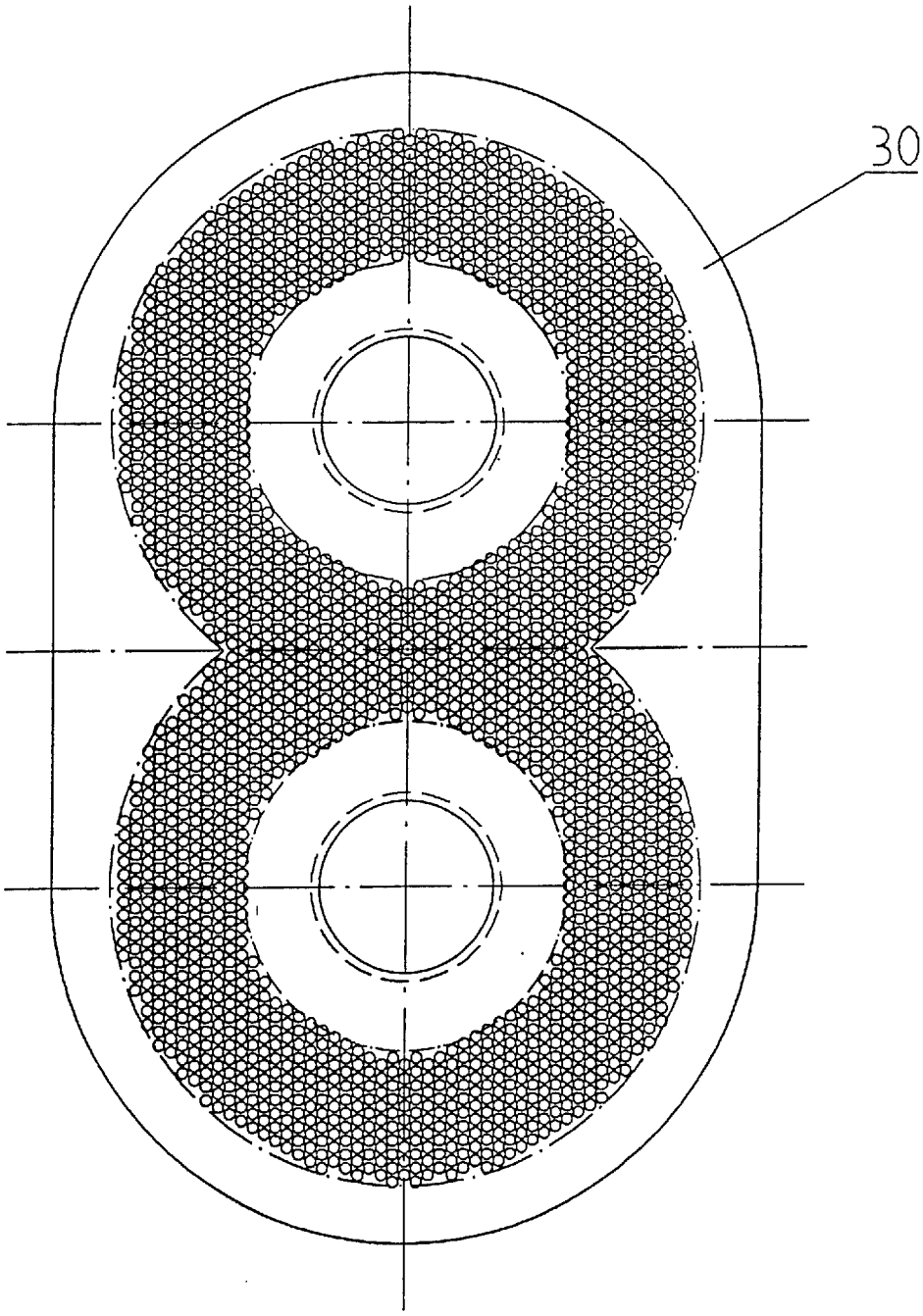

FIG. 6 two knives of the kind shown in FIG. 1, in a paired arrangement;

FIG. 7 depicts the attachment of a knife on the bearing pin of a feed worm;

FIG. 8 is a sectional side elevation of a double precutter;

FIG. 9 depicts the disposition of a plurality of cutter sets in the transition area;

FIG. 10 is a front elevation of two feed worms having cutter sets mounted thereon; and FIG. 11 is a double perforation cutting disk.

DETAILED DESCRIPTION OF PREFERRED EMBODIMENTS

Figure 2:
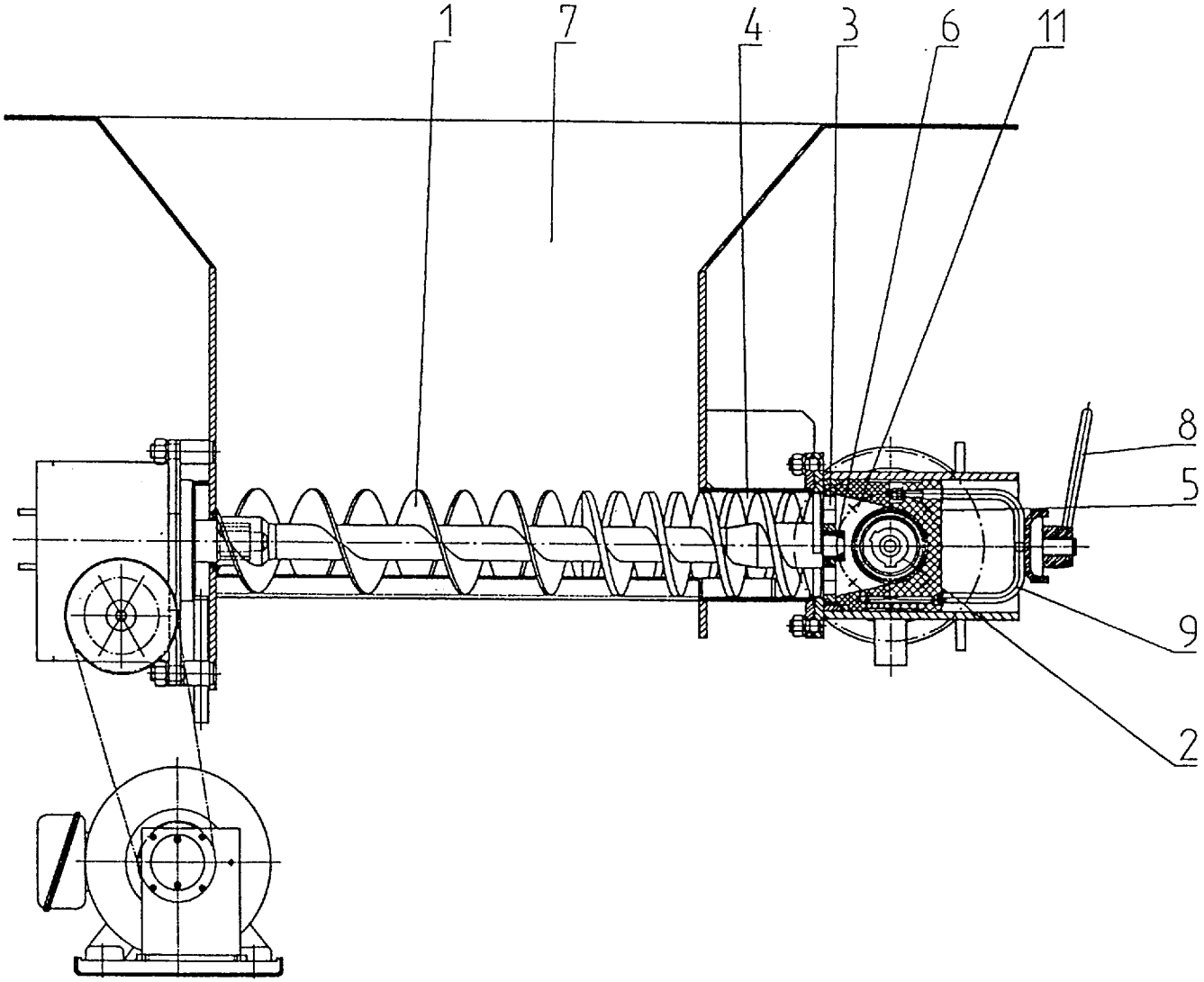
FIG. 2 depicts the mounting of the feed worm and working worm.

FIGS. 1 and 2 depict the mounting and lay-out of the feed worms 1 relative to the working worm 2. They also show that in the area of transition 11 from the feed worms 1 to the working worm 2 there is provided a double precutter 3. The feed worms 1 are disposed parallel to each other such that the flutes of one are positioned in the interspaces between the flutes of the other. By their rotation in opposite directions, the worms 1 transport any material to be cut to the area of transition 11. Not only is the material to be cut fed under pressure to the transition area 11, it also is circumferentially supported by a pressure chamber 4 formed by appropriate inserts positioned forward of the area of transition 11, i.e. over the final flute convolutions of the feed worms 1.

The double precutter 3 is mounted at the very end of the feed worms 1. Bearing bushes 26 of the double precutter 3 rotatably receive the pivot pins of the feed worms 1. The double precutter 3 and the knives 17 in front thereof are supported by, and mounted on, filling or closure members 5. As may be seen from the drawings, a space of large volume is provided by the transition area 11 between the feed worms 1 and the working worm 2. The space serves to feed the diminuted material to be cut to the working worm 2 whereby it is fed through a pressure housing to a precutter arrangement. It is important to note the feeding of the material from the feed worms 1 to the working worm 2 is such that the material completely fills, and is in intimate contact with the walls of, the space constituting the area of transition.

The actual lay-out and construction of the mounting of the feed worms 1 is shown in FIG. 2. The exact journaling at the left end of the worms 1 and their drive have only been shown schematically. As is clearly shown, the material to be cut is fed to a very large portion of the feed worms 1 through a feed hopper 7. At the left end of the feed worms 1 the pitch of the flutes is larger than at the right or output end in the change-over area 11 to the working worm 2. The reduction in the flute pitch results in a certain compression of the raw material. This, in turn, affects the necessary build up of pressure of the raw material which is augmented and positively influenced even more in the pressure chamber 4.

The axes of the feed worms 1 are disposed in the plane of the working worm 2. The coplanar mounting of the feed worms 1 and of the working worm 2 is ensured by the filling and closure member 5. The filling and closure member 5 is clamped through an arcuate member 9 by means of a quick release closure lever 8 such that the filling and closure member 5 partially extends around the working worm 2. At the same time, it affects and resiliently suspends of mounts the double precutter 3. The feed worms 1 are journaled by their pins in respective bearings 6 and are supported and aligned by the filling and closure member 5. This special construction of the suspension and the presence of the transition space 11 ensure quick assembly and disassembly of the working worm 2, the double precutter 3 and of the knives 17.

Figure 3:
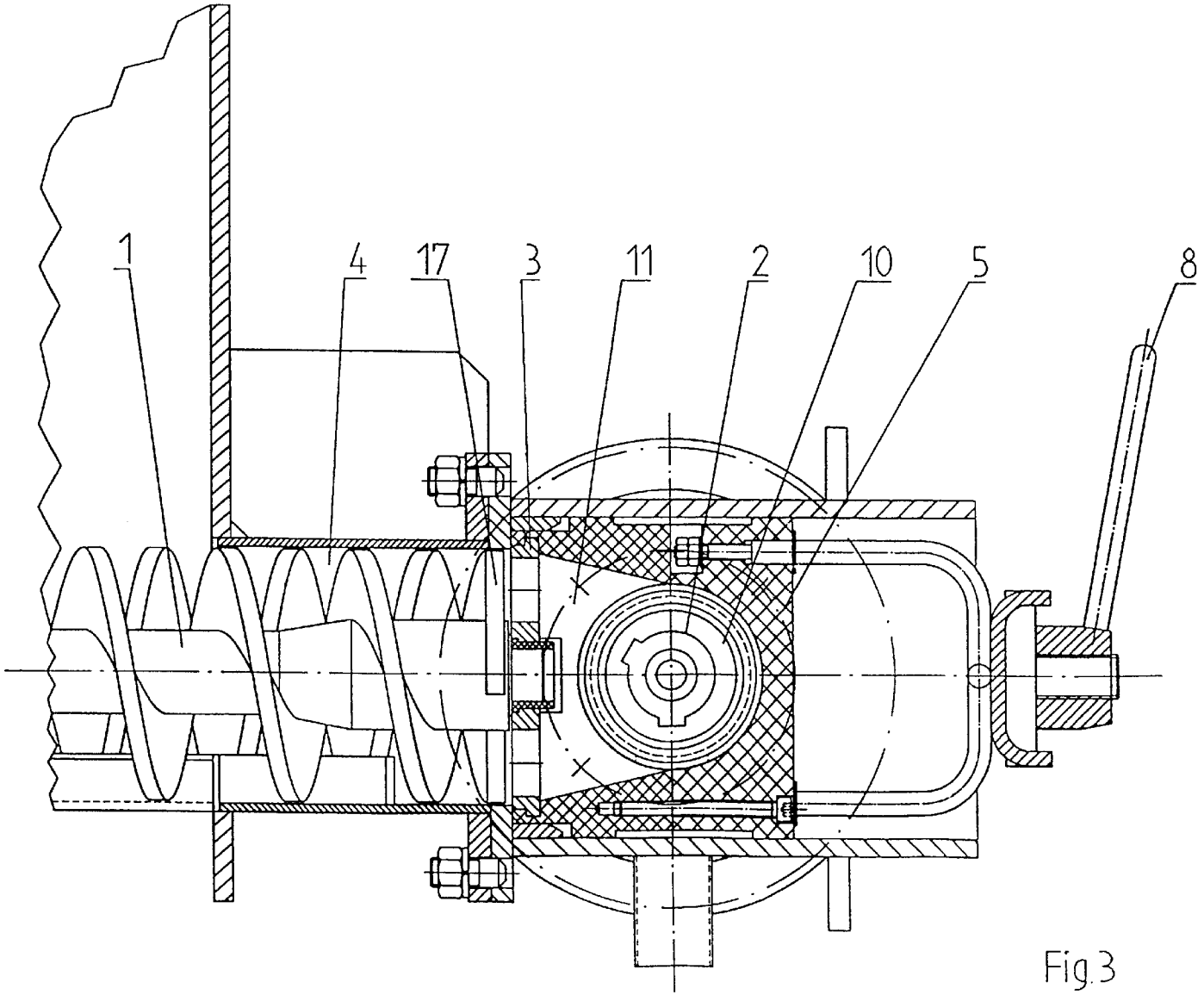
FIG. 3 is a detailed view, partially in section, of the apparatus of FIG. 2.

The lay-out of the transition area 11 has again been shown in a detailed view of FIG. 3. Both the transitional area 11 and the working space 10 of the working worm 2 are clearly shown in the drawing.

Figure 4:
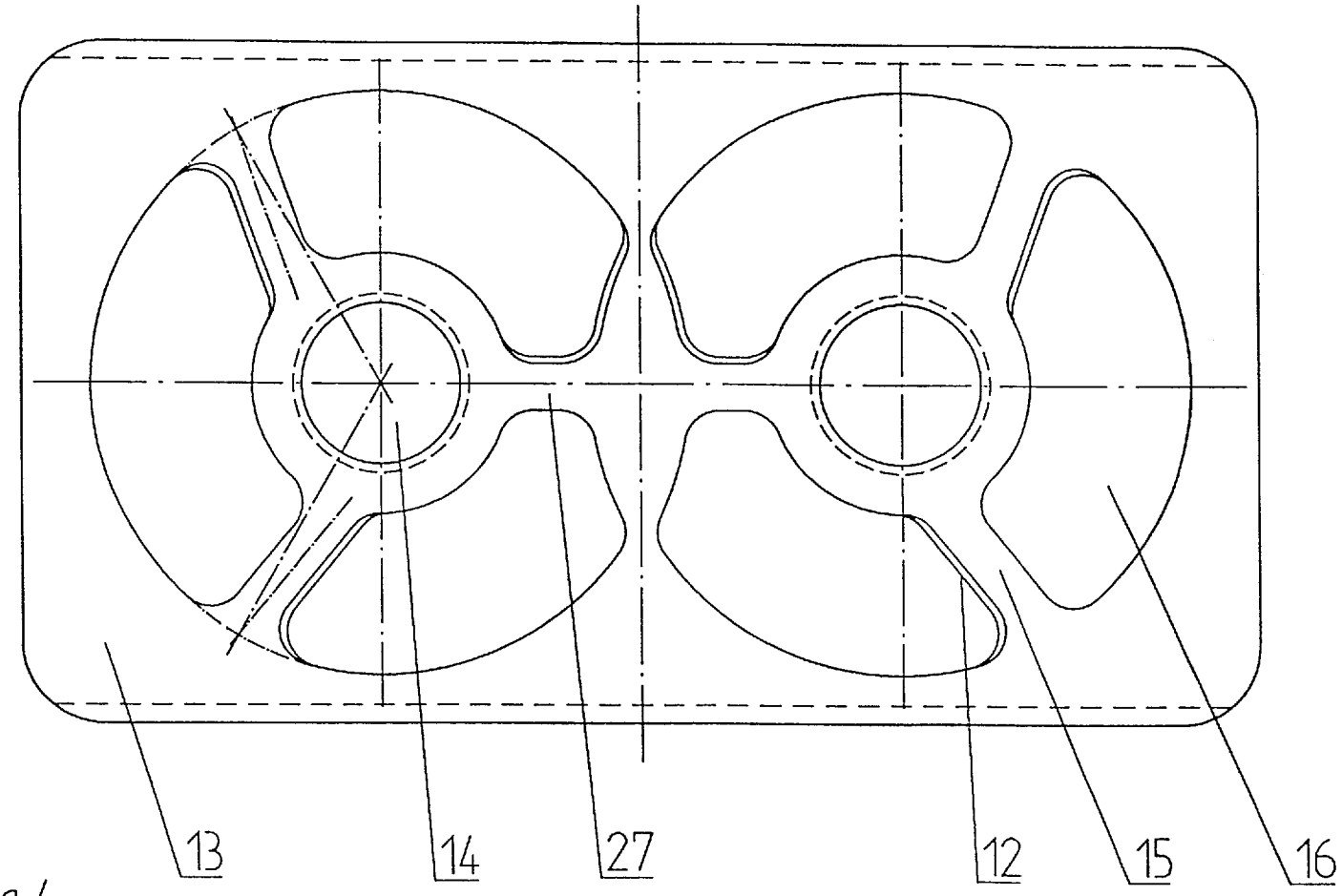
FIG. 4 is a schematic front elevation of the precutter.

The double precutter 3 is shown in FIG. 4. As may be seen, the double precutter 3 is made up of a so-called cutting plate 13 which preferably is of rectangular shape. The double precutter 3 is provided with support or knife webs 15, 27 with cutting edges 12. Furthermore, the cutting plate 13 is provided with a plurality of substantially kidney-shaped openings 16 concentrically circularly disposed around center bores 4 and interrupted by the knife webs 15, 27 radially extending from an annular member forming the bore 14. In the arrangement shown, three openings 16 each are disposed around two bores 14. The size and curvature of the openings 16 relates to the diameter and circumference of the rotatonal feeders, i.e the flutes of the feed screws 1. Preferably, the double precutter 3 is provided with three knife or support webs 15, 27 and a corresponding number of openings 16. The webs 15, 27 are sufficiently rigid to provide adequate support to the cutting plate 13.

The center bores 14 are lined by bearing bushings 26 within which pins of the feed worms 1 are journaled and supported. They also support rotary knives 17 removably seated on the pins of the feed worms 1 and engaging the cutting plate 13 and its knife edges 15, 27.

Figure 5:
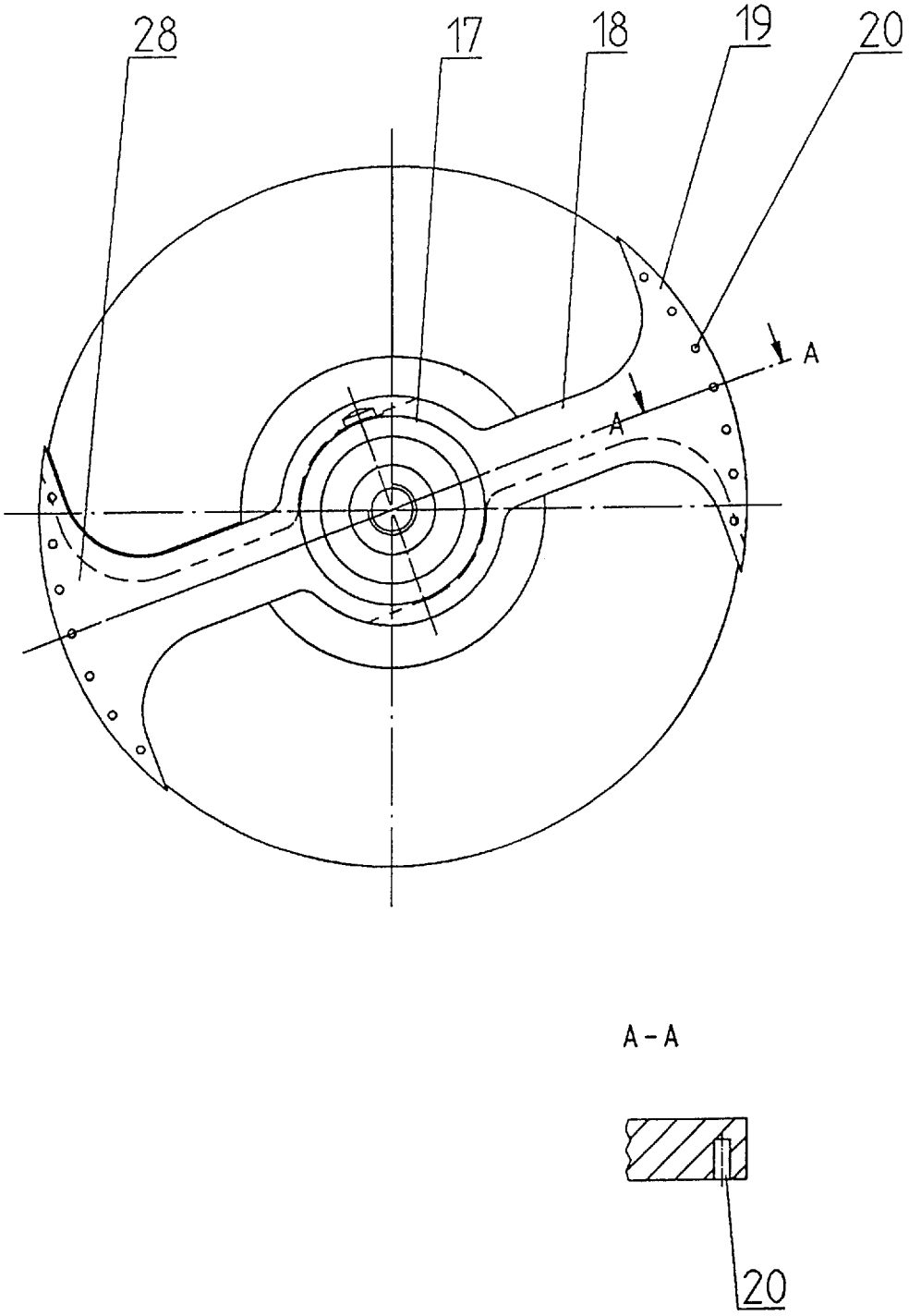
FIG. 5 depicts a knife with polymeric bolts inserted therein.

As shown in FIG. 5, the knives 17 are of special configuration. Each knife 17 is provided with a pair of blade arms 18 extending radially in opposite directions and provided with cutting edges 28. The special configuration of the knives 17 is due to support segments 19 at the outer ends of the blade arms 18. These segments, in fact, constitute segmented support rings 19. Adjacent its periphery, the segmented support ring 19 is provided with recesses for receiving polymeric bolts 20. The disposition of the knives 17 with respect to the cutting plate 13 is such that the heads of the polymeric bolts 20 engage the surface of the cutting plate 13 surrounding the openings 16 and serve to reduce friction and, hence, wear and tear, between the knives 17 and the cutting plate 13.

The relative position of two knives 17 is shown in FIG. 6. As may be seen, the distance between the axes of rotation of the knives 17 is less then the length of two blade arms. The knives 17 are coplanarly mounted such that their blade arms 18 are angularly displaced relative to each other. One of the knives 17 has its knife blades 18 disposed at an angle $\gamma$ relative to a vertical line, and the blades 18 of the other knife 17 are preferably disposed at an angle $\beta$ relative to a vertical line. Preferably, the angles $\gamma$ and $\beta$ measure 70° and 40°, respectively. In the mounted state, the blade arms 18 of the two knives 17 are angularly displaced by an angle $\alpha$ in the range of about 30° to 50° and, preferably, 30°. This arrangement ensures when during operation of the machine the knifes 17 are rotated in opposite directions their cutting blades 18 with their end segments do not interfere with each other. The free space between the opposite blade arms 18 marked by reference numeral 24 also indicates the face surface of the forward flute of a feed worm 1.

FIG. 7 depicts the layout and structure of the double precutter 3 and of the knives 17 including a feed worm 1. As shown, a pressure member 23 is mounted in a coaxial recess at the end of the core shaft 22 of the feed worm 1. The pressure member 23 is resiliently supported by a helical compression spring 21. The compression mounting arrangement of the double precutter 3, the knives 17 and the feed worms 1 is completed by the filling and closure member 5, as shown in FIGS. 2 and 3. The knives 17 are secured for rotating with the feed worms 1 by a keyed arrangement 29 well known in the art.

FIG. 8 is a cross-sectional view of the double precutter 3 showing the mounting of the bearing bushings 26 in the center bore 14.

In the operation of the machine the material to be cut is fed through the feed hopper 7 onto the feed worms 1. Feeding of the material is, in fact, a longitudinal distribution in the nature of a multi chamber distribution ensuring a uniform load on the entire machine.

The special structure of the support of the feed worms 1 with their associated knives 17 ensure the cooperation between the cutting plate 13, i.e., the double precutter and the filling and closure member 5. During operation, the knives 17 disposed at the angles described follow the flutes 24 of the feed worms 1 which in cooperation with the resilient mounting of the bearing pins will ensure excellent cutting of the material. As the springs 21 are compressed against the knives 17 seated at the final flute convolution of the feed worms 1, tension is generated which acts as a shearing force between the knives 17 and the double precutter 3. The shearing force results from the filling and closure member 5 pressing the double precutter 3 completely against an abutment, thus compressing the springs 21 behind the pressure member 23. This also causes the knives 17 to be pressed against the double precutter 3. When the filling and closure member 5 is in its terminal position the knives 17 will be seated completely in the key slots 28 in the final flute convolutions of the feed worms 1 and will, therefore, rotate with the feed worms 1 relative to the double precutter 3.

By rotation of the feed worms 1 the raw material is pressed by the parallel flutes 24 in a centered manner through the openings 16 of the double precutter 3 and cut by the rotating knives 17. This results in relatively uniform chunks of the raw material which may easily be received by the flute chambers of the working worm 2 by which the material is fed to further cutting apparatus to be subjected to final cutting.

FIGS. 9 and 10 demonstrate that food cutting machines such as meat grinders can be equipped with simple cutting tools and that different operational planes can be brought into conformity by cutting and support systems in accordance with the invention. This is made clear particularly by FIG. 9 showing the arrangement of a double precutter 3, knives 17 and a perforated cutting disk 30 in the area of transition. The structure of the perforated disk 30 is shown in FIG. 11. Another substantial advantage of the new invention that it may be applied in various combinations. While combined cutting and suspension systems are at present preferred, it is within the scope of the invention to make use of these elements separately.

What is claimed is:

1. A food cutting apparatus, comprising:

working worm means mounted in a given plane for rotation about a first axis;

feed worm means mounted in said plane for rotation about a second axis and provided with coaxial recess means at an output end of said feed worm means for receiving bearing pin means for resilient sliding movement relative thereto;

change-over means between said output end of said feed worm means and a receiving section of said working worm means;

substantially non-rotating cutting disk means comprising substantially planar circular cutting surface means having a plurality of openings therein and disposed in a second plane intersecting said given plane and provided with bearing means for rotatably receiving said bearing pin means;

rotary knife means mounted on said bearing pin means for coaxial rotation with said feed worm means in engagement with said cutting surface means; and means for biasing said rotary knife means against said cutting surface means.

2. The apparatus of claim 1, wherein said feed worm means comprises first and second worm means disposed in parallel to each other each mounting rotary knife means.

3. The apparatus of claim 2, wherein said second axis intersects said first axis in a direction normal thereto at a position substantially at said receiving section.

4. The apparatus of claim 3, wherein said cutting disk means comprises two cutting surface means and two bearing means in side by side disposition.

5. The apparatus of claim 4, wherein said means for biasing comprises substantially arcuate means disposed to embrace said working worm means and engaging said cutting disk means at a surface thereof opposite said cutting surface means.

6. The apparatus of claim 5, wherein said means for biasing further comprises means for axially moving said arcuate means relative to said feed worm means.

7. The apparatus of claim 6, wherein said cutting surface means comprises first cutting means adjacent each of said openings.

8. The apparatus of claim 7, wherein said bearing means in said cutting disk means comprises a bore disposed centrally of said cutting surface means and wherein said openings are disposed concentrically around said bore.

9. The apparatus of claim 8, wherein said openings are of substantially arcuate configuration.

10. The apparatus of claims 9, wherein said rotary knife means comprises a pair of radial blade arm means extending in opposite directions.

11. The apparatus of claim 10, wherein said blade arm means are provided with substantially arcuate end section means.

12. The apparatus of claim 11, wherein said rotary knife means on said first and second worm means are angularly displaced relative to an angle between 30° and 50°.

13. The apparatus of claim 12, wherein said arcuate end section means is provided with axially extending friction reducing means for engaging said cutting surface means.

14. The apparatus of claim 13, wherein said friction reducing means comprises polymeric bolt means seated in axial bores in said arcuate end section means.

* * * * *